US006332794B1

(12) United States Patent
Tzeng Jeng

(10) Patent No.: US 6,332,794 B1
(45) Date of Patent: Dec. 25, 2001

(54) SWIVELLABLE RECEPTACLE

(76) Inventor: Nian Mei Tzeng Jeng, No. 1-1. Kuo-Chi Rd., Hsin-Shin Hsiang, Tainan Hsien (TW)

( * ) Notice: Subject to any disclaimer, the term of this patent is extended or adjusted under 35 U.S.C. 154(b) by 0 days.

(21) Appl. No.: 09/563,401

(22) Filed: May 3, 2000

(51) Int. Cl.[7] ..... H01R 29/00

(52) U.S. Cl. ..... 439/188; 439/13

(58) Field of Search ..... 439/13, 188, 21, 439/11, 135, 136, 137, 138, 139; 200/51.09, 51.1, 51.11, 317, 17, 346

(56) References Cited

U.S. PATENT DOCUMENTS 3,737,591 * 6/1973 Parlato ..... 200/61.93
4,520,243 * 5/1985 McIntyre ..... 2000/51.07
5,035,635 * 7/1991 Tsai et al. ..... 439/188
5,044,969 * 9/1991 Richier ..... 439/188
5,259,778 * 11/1993 Zhang ..... 439/188
5,286,213 * 2/1994 Altergott et al. ..... 439/139
5,352,122 * 10/1994 Speyer et al. ..... 439/13
5,683,254 * 11/1997 Lin ..... 439/11
5,775,921 * 7/1998 Chou ..... 439/21
5,795,168 * 8/1998 Duhe ..... 439/188
5,871,378 * 2/1999 Poiraud et al. ..... 439/676
5,997,310 * 12/1999 Chiu et al. ..... 439/21
6,015,307 * 1/2000 Chiu et al. ..... 439/139
6,079,995 * 6/2000 Duhe, Jr. ..... 439/188
6,089,921 * 7/2000 Chou ..... 439/640
6,093,028 * 7/2000 Yang ..... 439/13

* cited by examiner

*Primary Examiner*—Gary Paumen
*Assistant Examiner*—Phuong Chi Nguyen
(74) *Attorney, Agent, or Firm*—Rosenberg, Klein & Lee

(57) ABSTRACT

A swivellable receptacle includes a swivel device, a conducting device and a fixture. The receptacle has conducting strips. The swivel device has a trough and is mounted on the receptacle. The conducting device has a conductor to be inserting into a trough of the swivel device. A fin extends from the conductor. The fixture comprises studs to press the conductor of the conducting device, whereas the fins of the conducting device will always in touch with the conductor of the receptacle and the stud of the fixture will always in touch with the conductor while the receptacle is swiveling.

6 Claims, 9 Drawing Sheets

SWIVELLABLE RECEPTACLE

BACKGROUND OF THE INVENTION

1. Field of the Invention

This invention relates to an electrical receptacle, and more particularly to a receptacle which is swivellable and can prevent from loosening.

2. Description of Prior Art

A conventional electrical receptacle has a swivellable type which comprises a swivel device and conductors. The conductors are mounted in a trough of the swivel device and have contacting points at the bottom thereof and extends from the shell.

The conventional device has a number of shortcomings, one of which is that the feet of a plug are inserted into the receptacle directly without any fixture to hold the plug from loosening when they are pulled by force accidentally.

SUMMARY OF THE INVENTION

It is the primary object of the present invention to provide a swivellable receptacle which receptacle is swivellable while the plug is plugged in.

It is another object of the present invention to provide a swivellable receptacle which is special deigned to prevent plug from being unplugged accidentally.

It is a further object of the present invention to provide a swivellable receptacle which is easy to operate and more secure.

DETAILED DESCRIPTION OF THE DRAWINGS

Figure 1:
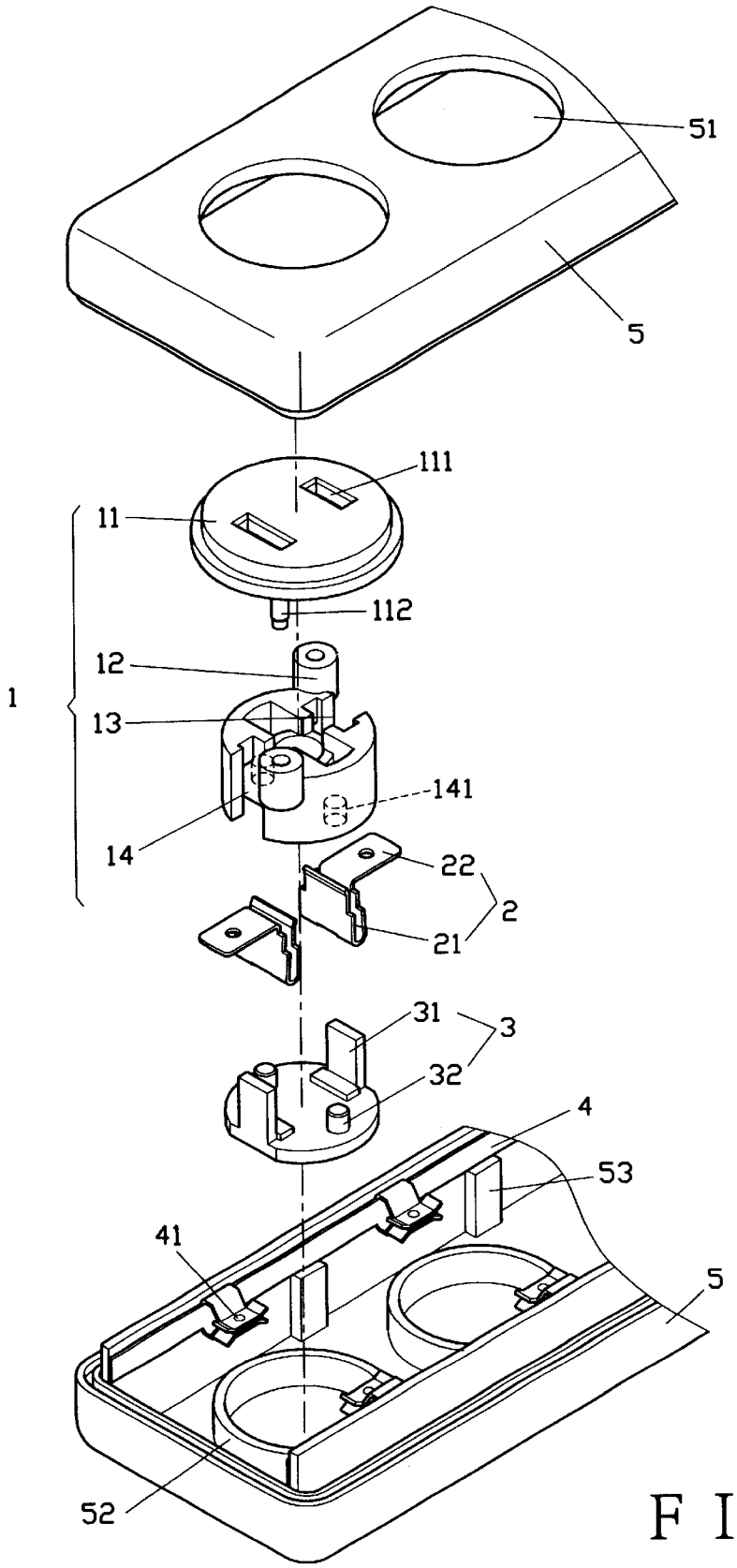
FIG. 1 is an exploded view of the present invention.

A swivellable receptacle of the present invention, as shown in FIG. 1, includes a swivel device 1, a conducting device 2 and a fixture 3, and is accompanied by a conducting strip 4 and a receptacle 5.

The receptacle 5 has holes 51 on the top, guards 52 at the bottom, and side plates 53 at respective sides to hold the conducting strip 4.

The swivel device 1 has covers 11 which fit into the holes 51 of the receptacle 5. A pair of slots 111 are made on the top of each cover 11. The bottom portion of the cover 11 comprises a pair of lugs 112 which correspond to a pair of lug holes 12 of the swivel device 1. The swivel device 1 is also composed of two troughs 13 at respective sides thereof, and a pair of locating blocks 14 at the bottom thereof.

The conducting device 2 is formed by two pieces of conductors 21 extending upward and outward to form a fin 22 on each conductor 21 which is a one piece and can be bent to form a clip thereat.

The fixture 3 has a pair of studs 31 at respective sides for the conducting device 2 to be secured thereat. A pair of posts 32 corresponding to the locating holes 141 are formed on the fixture 3.

The conducting strip 4 is a flat plate and comprises clips 41 equally spaced from each other.

Figure 2:
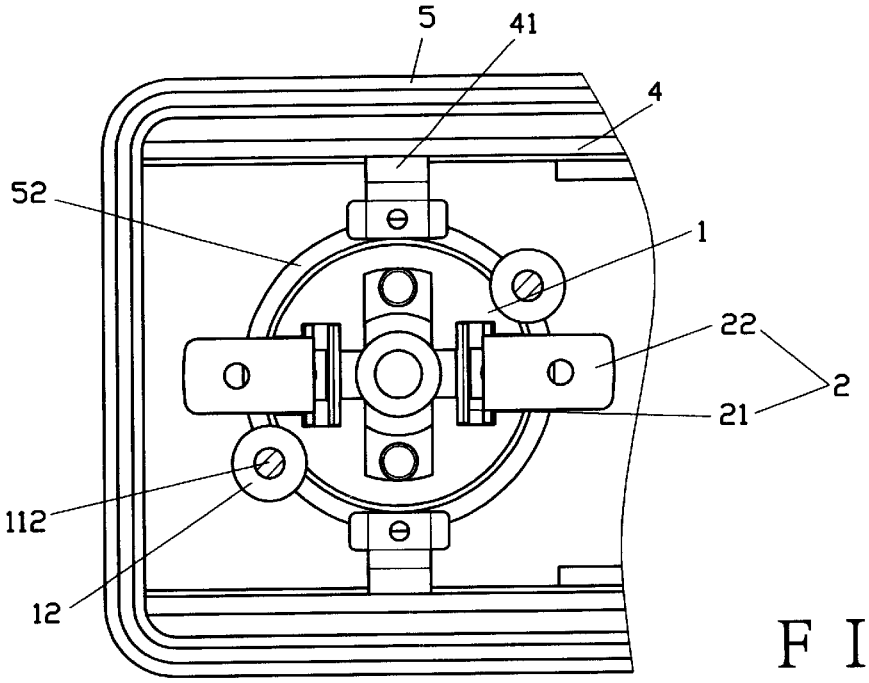
FIG. 2 is a top perspective view of the present invention.

To assemble, place the two conducting device 2 in the troughs 13 of the swivel device 1 with the fins 22 extending outward from the swivel 1. One side of each conductor 21 engages with one side of each locating block 14, whereas the posts 32 of the fixture 3 are inserted into the locating holes 141 which secure the fixture 3 to the swivel 1. The other side of each conductor 21 is pressed by the stud 31 so that a clip pressure is constantly applied to the conducting device 2. Upon the receptacle 5 is covered, the fixture 3 and the swivel device 1 are both enclosed within the guard 52 of the receptacle 5, and whereas the cover 11 on top of the swivel device 1 extends into the holes 51 of the receptacle 5 and the fins 22 of the conducting device 2 are disengaged with the conducting strip 4, as shown in FIG. 2.

Figure 3:
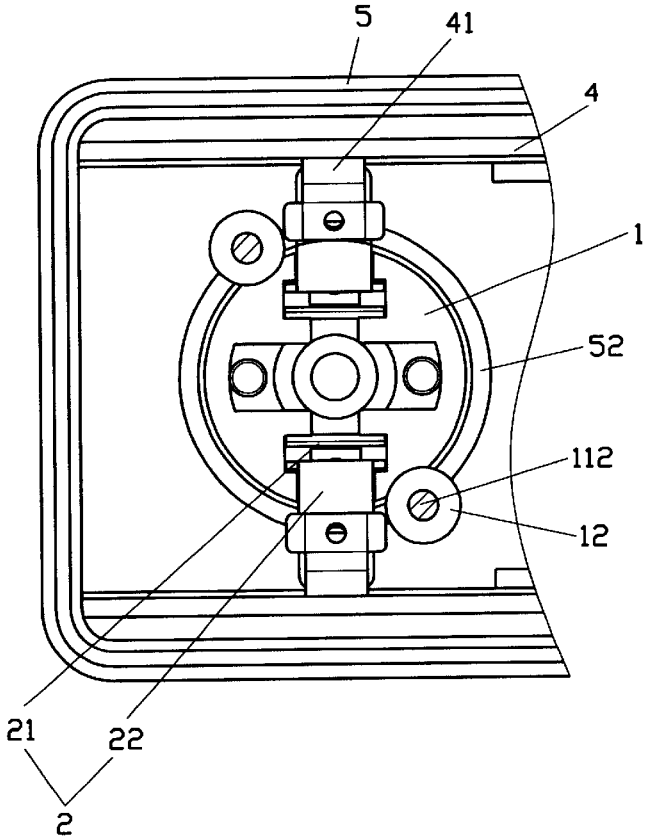
FIG. 3 is a view similar to FIG. 2, with the receptacle swivels to a different angle.
Figure 4:
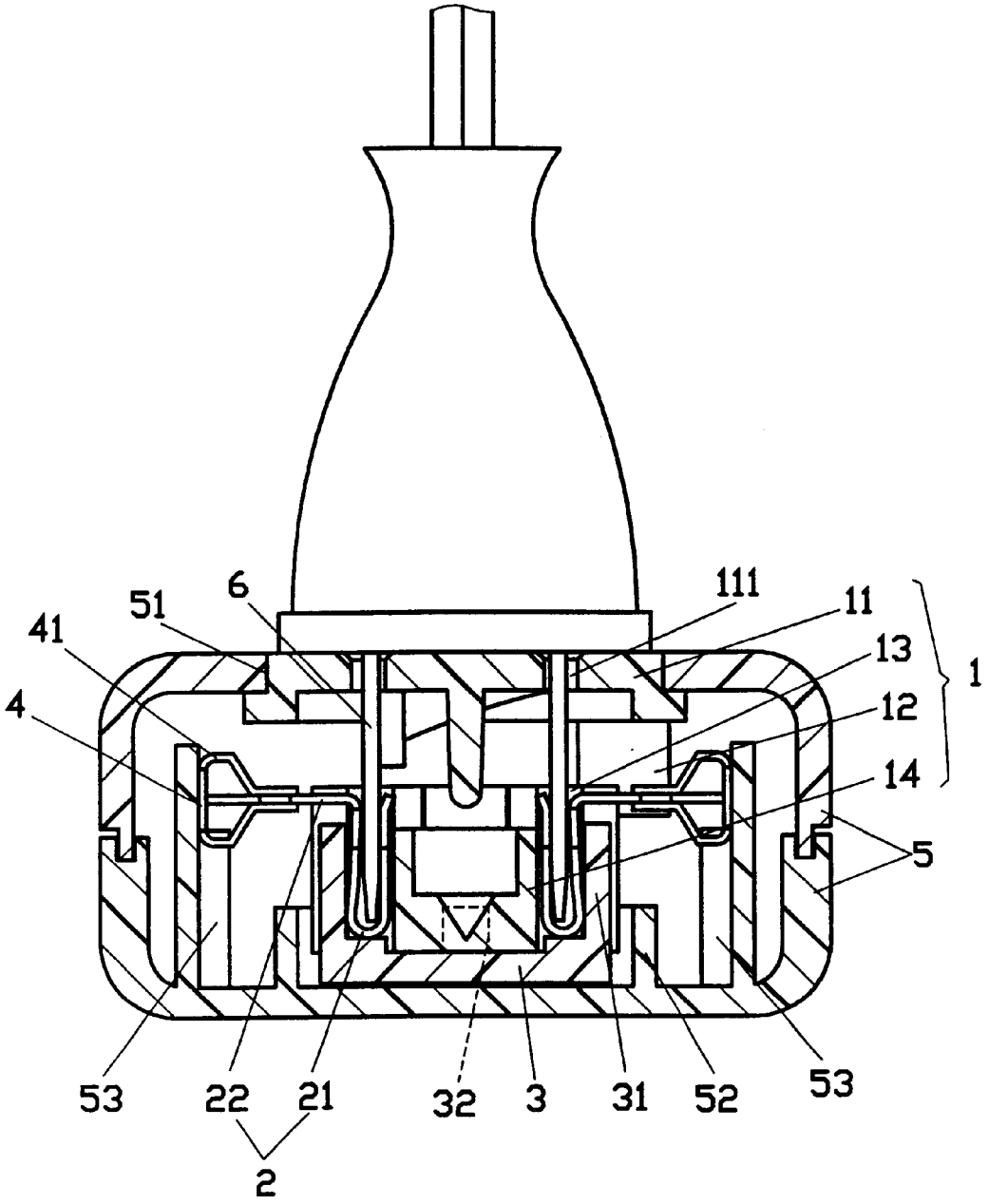
FIG. 4 is a side cross sectional view of FIG. 3.

To provide electrical power, as shown in FIGS. 3 and 4, insert feet 6 of a plug into the openings 111, and the prongs 6 of a plug are clipped by the conductors 21 of the conducting device 2 which secure the plug in place. Upon swiveling the swivel device 1, the fixture 3 and the cover 11 will swivel simultaneously, whereas the fin 22 of the conducting device 2 is displaced to bring the fin 22 into contact with the clip 41 of the conducting strip 4, this provides conduction to prongs 6 from the conducting strip 4 through the fins 22. To disconnect electric power, swivel the prongs 6 of the plug 5*o* their original position, which displaces the fins 22 of the conducting device 2 to disengage from the clips 41 of the conducting strips 4 to form an isolating state, and the plug may then be pulled out.

Figure 5:
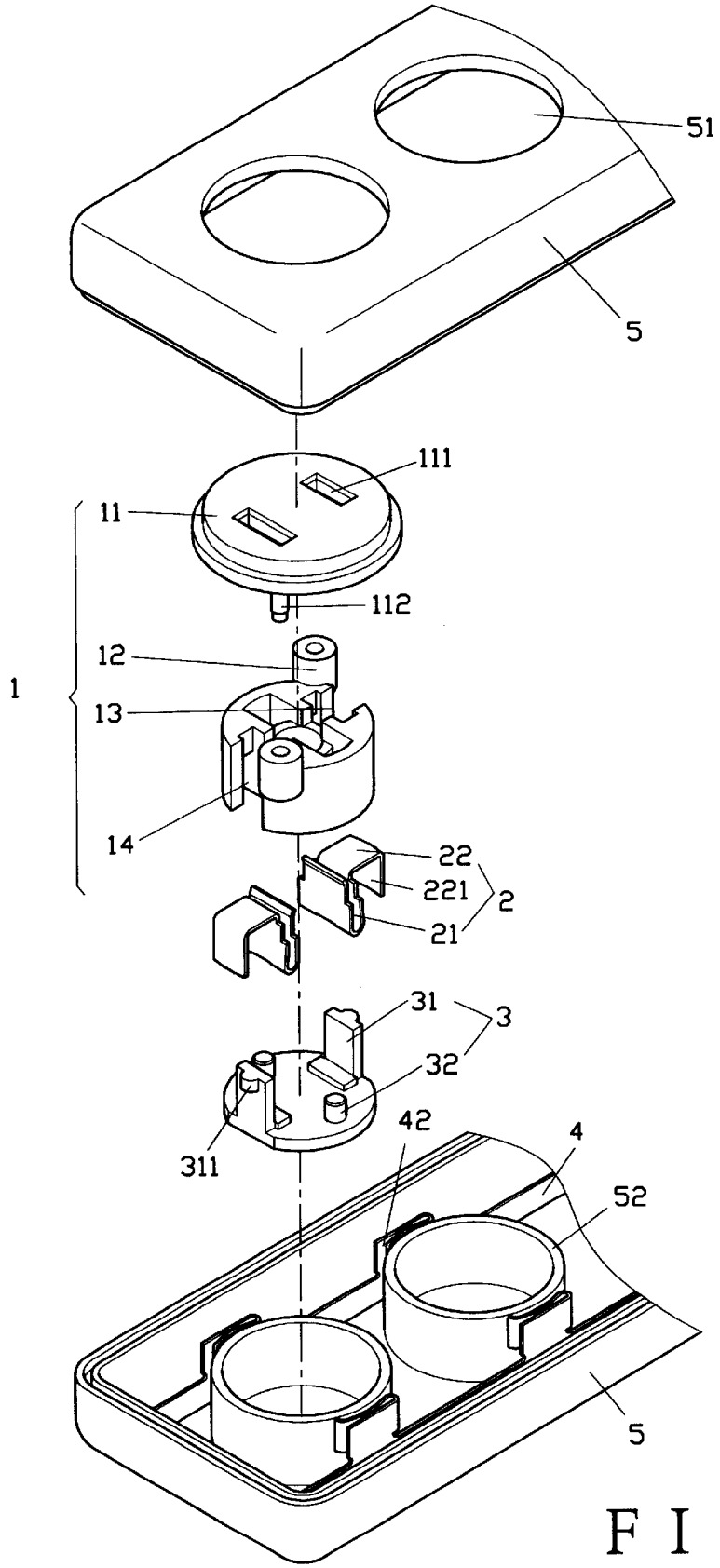
FIG. 5 is an exploded view of a second embodiment of the present invention.

FIG. 5 shows a second embodiment of the present invention which the guard 52 of the receptacle 5 are rising, and the two ends of the fin 22 bend downward to form a pair of flips 221. Further, the conducting strip 4 is bent to form holders 42 spaced from each other, and the studs 31 have a protuberance 311.

Figure 6:
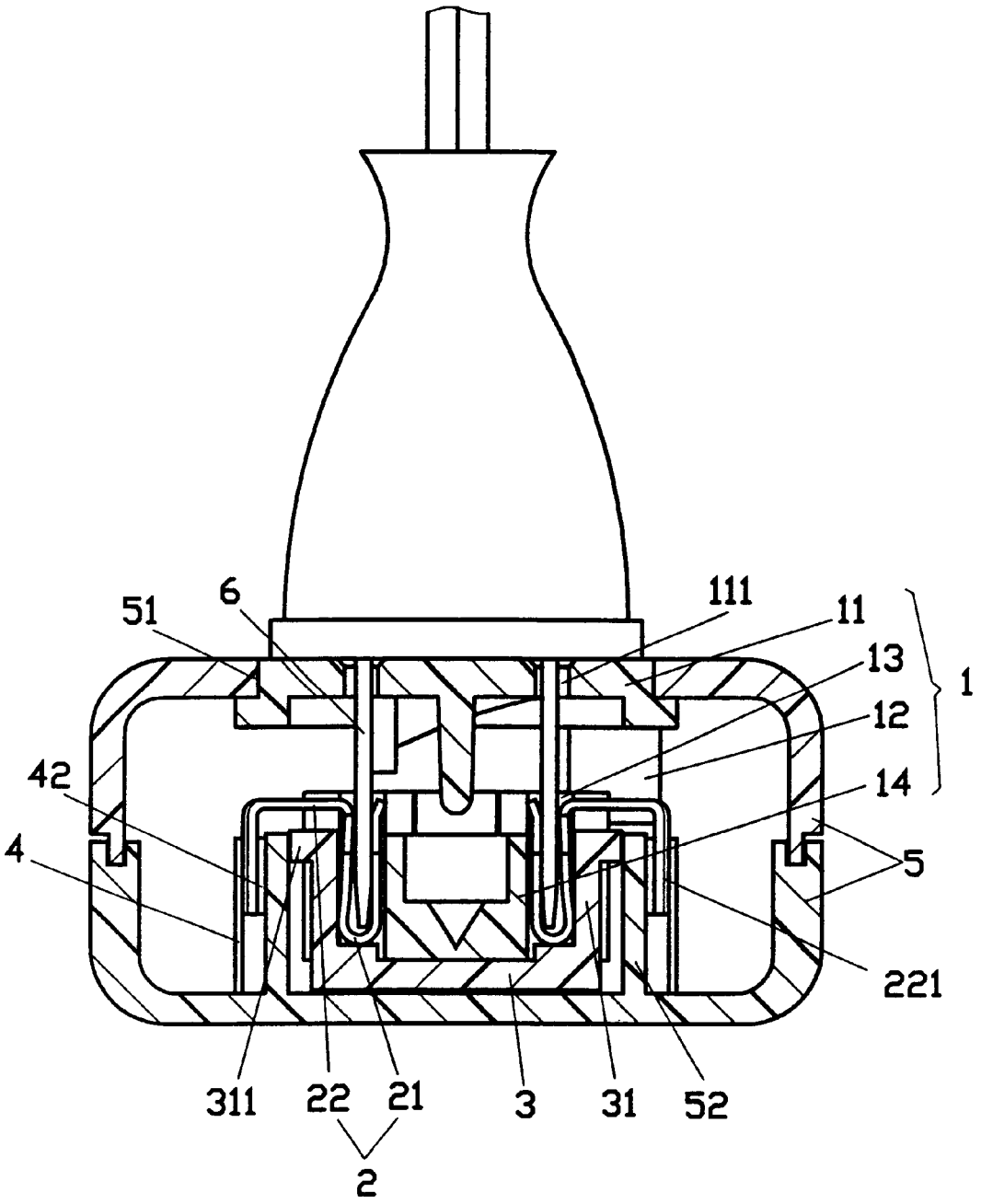
FIG. 6 is a side cross sectional view of FIG. 5.

To assemble, as shown in FIG. 6, insert the conducting strip 42 into the lower case of the receptacle 5 with the holders 42 against the guard 52. Thus, upon turning the prongs 6 inserted in the receptacle 5, the fins 22 of the conducting device 2 rotate with the prongs 6 with their flips 221 inserted into the holders 42 of the conducting strip 4 to conduct electric power. The protuberance 311 of the stud 31 of the fixture 3 engages with the inner wall of the guard 52 which enforces the stud of the fixture 3 in a constant pressure against the conducting strip 2.

Figure 7:
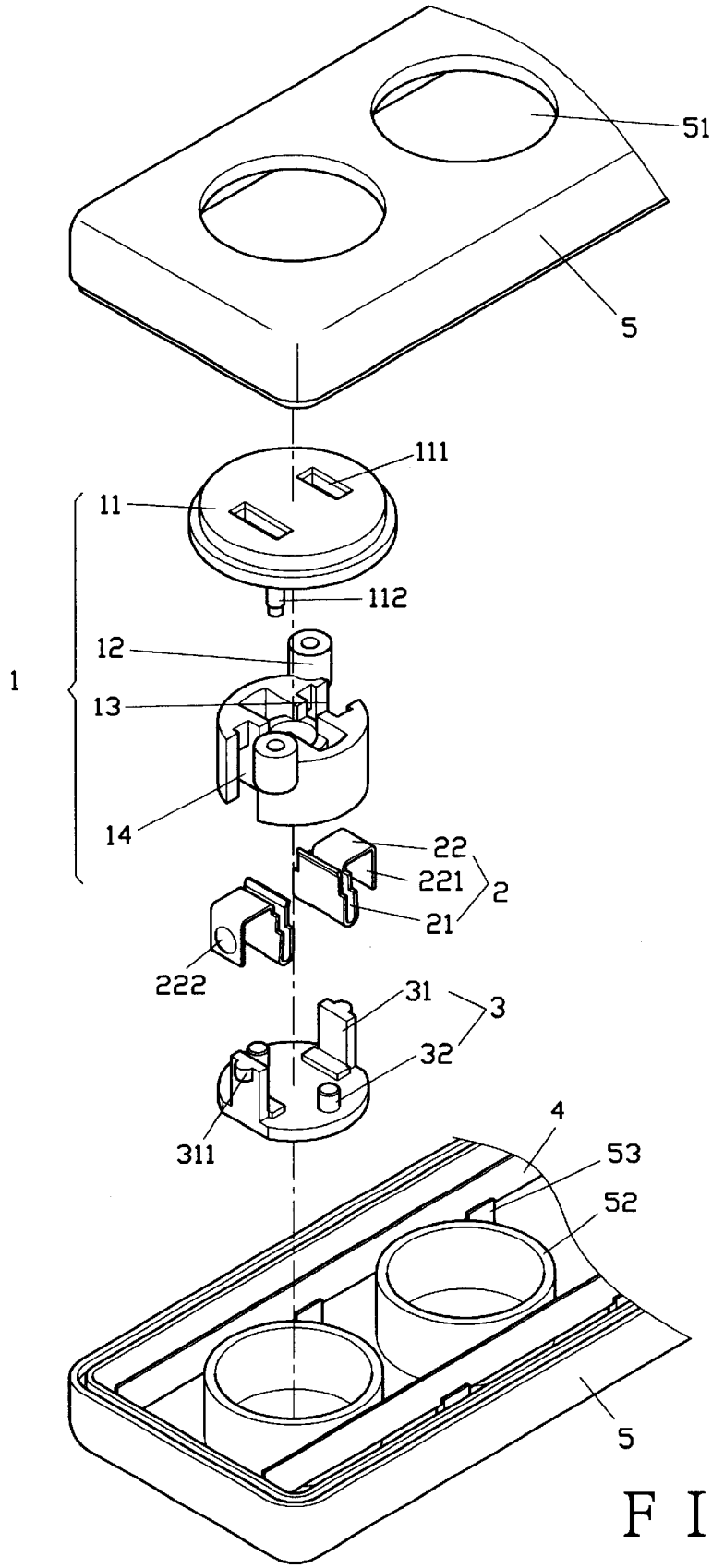
FIG. 7 is an exploded view of a third embodiment of the present invention.

FIG. 7 is a further embodiment which illustrates a bull eye 222 is formed on each flip 221 and the conducting strip 4 is a straight flat piece which is secured by the side late within the receptacle 5.

Figure 8:
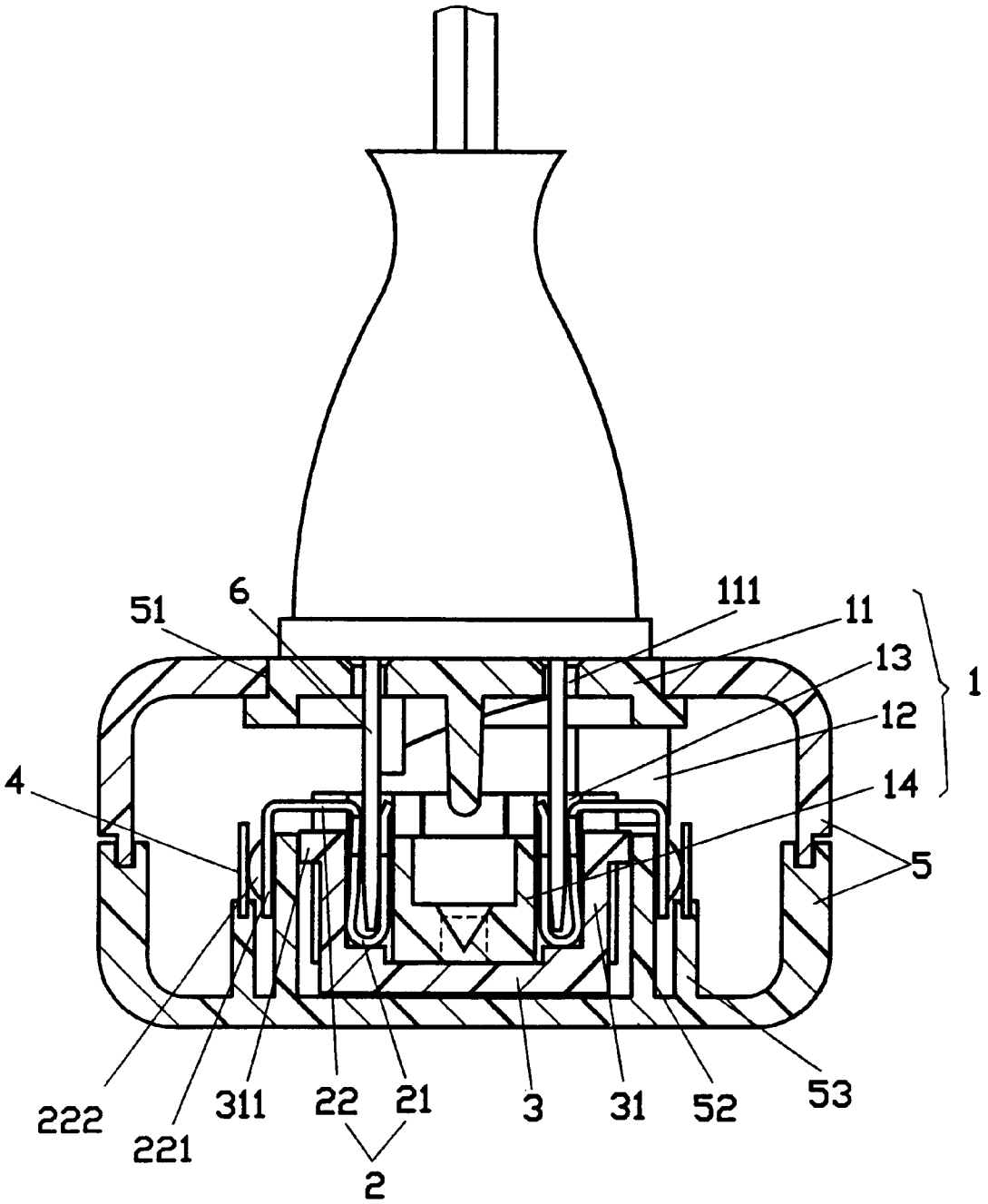
FIG. 8 is a side cross sectional view of FIG. 7.

To assemble, as shown in FIG. 8, place the fixture 3 in the guard 52 of the receptacle 5 with the protuberance 311 of the stud 31 of the fixture 3 engaging with the inner wall of the guard 52, whereas the stud 31 tends to squeeze inwardly. Insert the conducting device 2 into the trough 13 of the swivel device 1 which will be facing the fixture 3 at this moment. The conducting device 2 engages with the locating block 14 at one side and the stud 31 of the fixture 3 at the other side, and whereas the prong 6 is held securely by the conducting device 2. Thus, when the prong turns with the swivel device 1, the bulls eyes 222 on the flip 221 of the conducting device 2 will be engaged with the conducting strip 4 to form a closed circuit.

Figure 9:
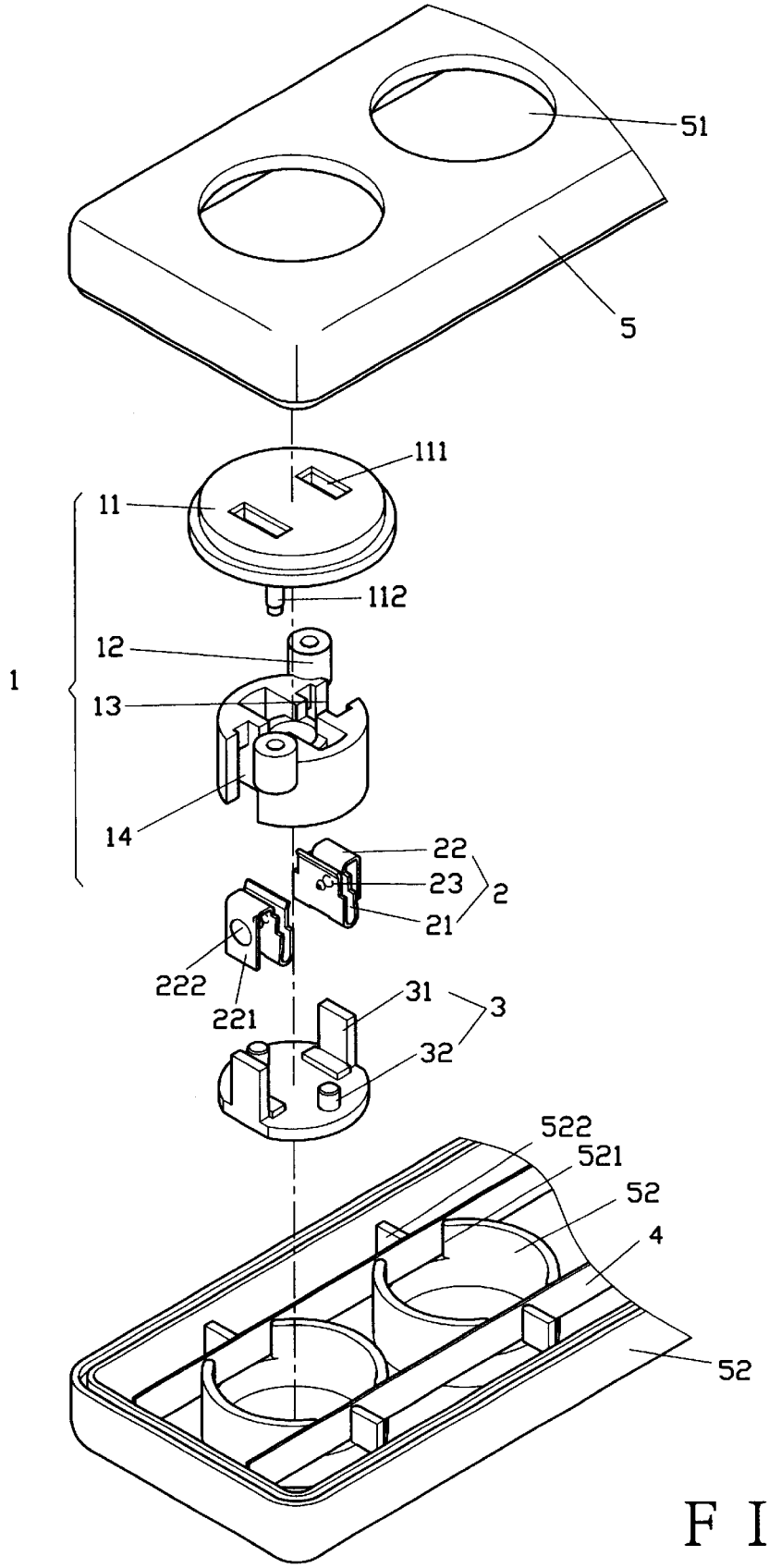
FIG. 9 is an exploded view of a fourth embodiment of the present invention.
Figure 10:
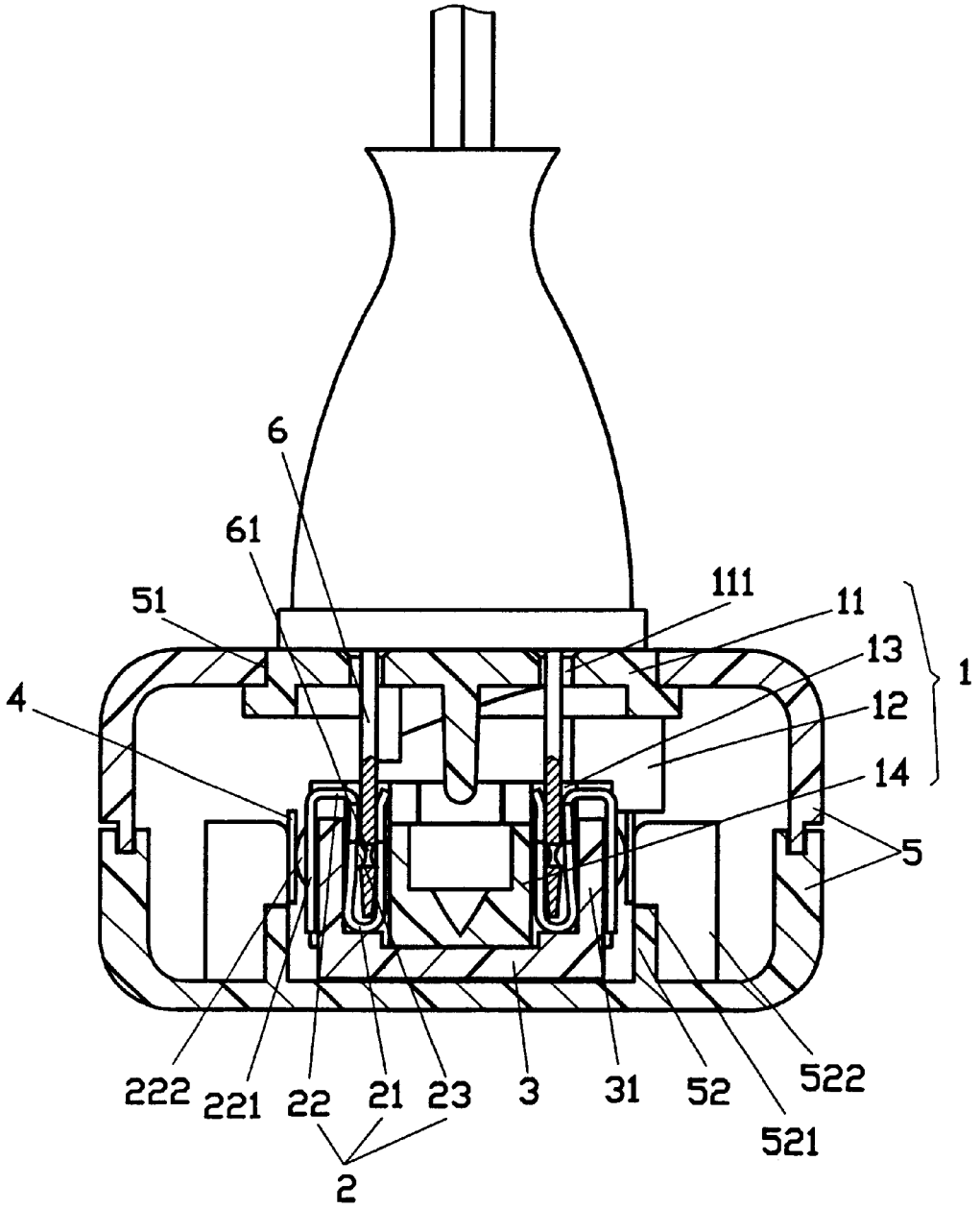
FIG. 10 is a side cross sectional view of FIG. 9.

Still further, the guard 52 of the receptacle 5 has notches 521 on its edge, as shown in FIG. 9, and a rib 522 at the center of the notch 521. To assemble, insert the conducting strip 4 through the notch 521 of the guard 52 secured by the rib 522. The same assemble method as shown in FIG. 10, the lip 221 of the conducting device 2 engages with the conducting strip 4 secured by the rib 521 within the guard 52.

The conductor 21 of the conducting device 2 faces the rib 23, and the prong 6 is formed with a hole 61. When the prong is inserted into the conductor 21, the rib 23 of the conducting device 2 will be inserted into the hole 61 to secure the prong 6 in place. Whereas one side of the conductor 21 of the conducting device 2 is engaged with the locating block 14 while the other side of the conductor 21 is engaged with the stud 31 of the fixture 3. By the opposing forces the prong 6 is disposed in tight engagement with the conductor 21 of the conducting device 2.

I claim:

1. A swivellable receptacle comprising a receptacle housing, a swivel device, a conducting device, a fixture and a plurality of conducting strips disposed within said receptacle housing, wherein said swivel device being secured within said receptacle housing in a rotatable manner and having a plurality of troughs formed therein;

said conducting device comprising a plurality of conductors respectively inserted into said plurality of troughs, each of said conductors having a fin extending outwardly therefrom;

said fixture being coupled to said swivel device with said conducting device therebetween and having a plurality of studs extending therefrom to respectively press against said conductors of said conducting device for adding a bias force thereto;

whereby upon insertion of prongs of an electrical plug into said swivel device, said fins of said conducting device are displaceable to respectively engage with said plurality of conducting strips, and said studs of said fixture securely engaging said conducting device to respectively bias said conductors to securely engage said prongs.

2. The swivellable receptacle as recited in claim 1, wherein each said fin of said conducting device is formed with two bends with a portion of said fin beyond said second bend facing downwardly to form a flip.

3. The swivellable receptacle as recited in claim 1, wherein each said conducting strip is formed with a plurality of holders.

4. The swivellable receptacle as recited in claim 1, wherein each said conductor of said conducting device has a rib formed thereon for engaging a hole formed in a corresponding prong of the electrical plug.

5. The swivellable receptacle as recited in claim 1, wherein each said fin of said conducting device is bent to form a holding portion thereon.

6. The swivellable receptacle as recited in claim 5, wherein each said conductor of said conducting device has a rib formed thereon for engaging a hole formed in a corresponding prong of the electrical plug.

* * * * *